United States Patent [19]

Avramovich

[11] 4,406,505

[45] Sep. 27, 1983

[54] GROUNDING CLIP FOR ELECTRICAL FIXTURES

[75] Inventor: Radosav Avramovich, Libertyville, Ill.

[73] Assignee: Daniel Woodhead, Inc., Northbrook, Ill.

[21] Appl. No.: 235,657

[22] Filed: Feb. 18, 1981

[51] Int. Cl.[3] ..... H01R 3/04

[52] U.S. Cl. ..... 339/14 R; 339/95 R

[58] Field of Search ..... 339/14 R, 14 P, 95 R, 339/95 A; 411/175, 174, 176, 184, 187, 189, 112, 523, 525, 526, 527, 528

[56] References Cited

U.S. PATENT DOCUMENTS

| | | | |
|---|---|---|---|
| 2,378,684 | 6/1945 | Carlstrom | 411/523 |
| 3,376,612 | 4/1968 | Munse | 411/523 |
| 3,432,793 | 3/1969 | Muska et al. | 339/14 R |
| 3,701,839 | 10/1972 | Smith | 339/95 R |
| 3,713,071 | 1/1973 | Poliak et al. | 339/14 R |
| 3,723,942 | 3/1973 | Dennison | 339/14 R |
| 3,757,268 | 9/1973 | Genovese et al. | 339/14 R |
| 3,810,069 | 5/1974 | Jaconette, Jr. | 339/14 R |

FOREIGN PATENT DOCUMENTS

| | | | |
|---|---|---|---|
| 2515301 | 8/1975 | Fed. Rep. of Germany | 411/523 |

*Primary Examiner*—Joseph H. McGlynn

*Attorney, Agent, or Firm*—Emrich, Lee, Brown & Hill

[57] ABSTRACT

A grounding clip provides a grounding path between a receptacle and mounting screw affixing the receptacle to a grounded mounting box. The grounding clip of spring steel has a screw-receiving means that receives a mounting screw. The edges of one side of the clip has sharp teeth which extend slightly outwardly. This side of the clip is between the tab on the mounting or junction box and the tab on the ground yoke of the receptacle. When the clip is assembled to the yoke and the yoke is mounted to the box with the mounting screw, the teeth on the clip bite into the tab on the yoke and flatten out laterally, thereby scraping any oxide off the yoke and insuring a good electrical contact between the ground yoke on the receptacle and the junction box.

15 Claims, 7 Drawing Figures

FIG. 1
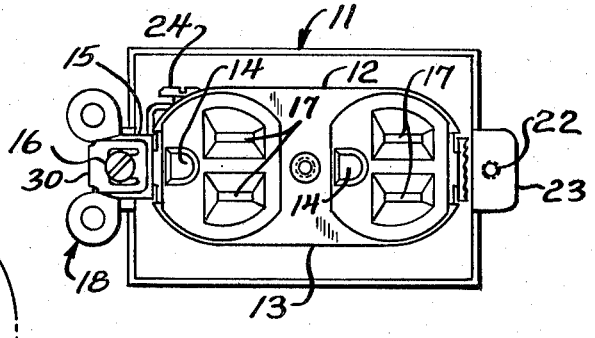
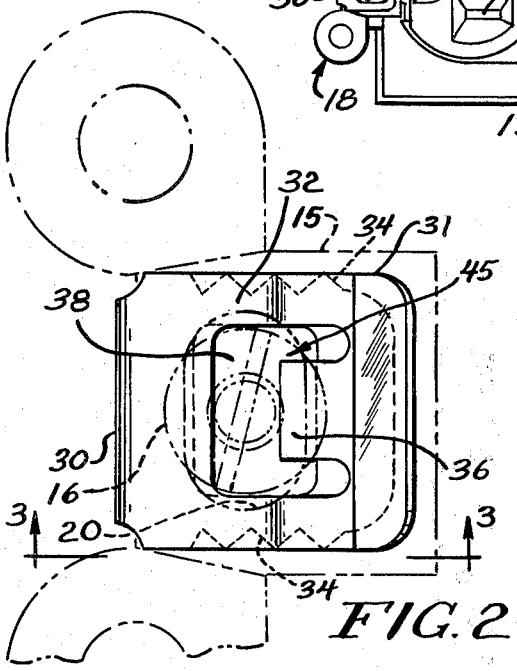
FIG. 2
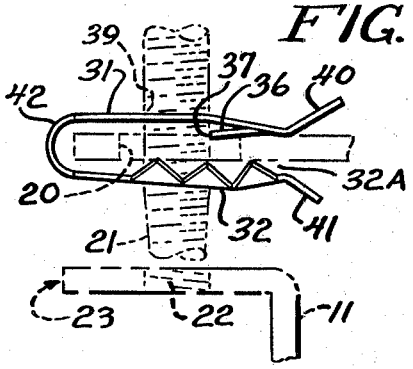
FIG. 3
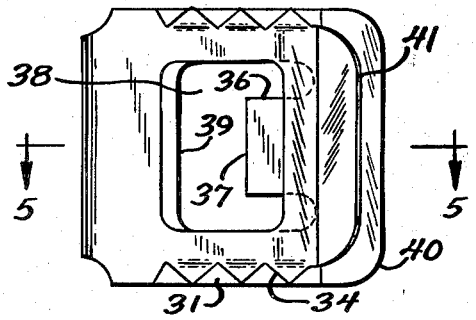
FIG. 4
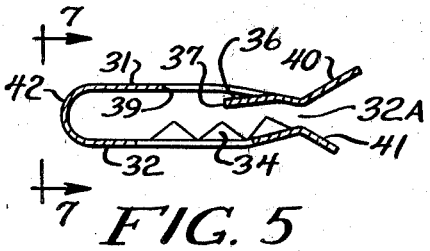
FIG. 5
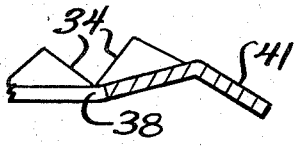
FIG. 6
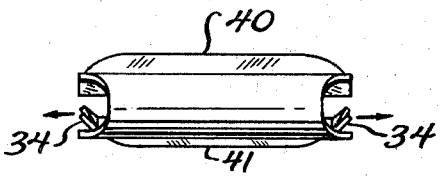
FIG. 7

GROUNDING CLIP FOR ELECTRICAL FIXTURES

BACKGROUND OF THE INVENTION

This invention relates to grounding clips for electrical fixtures, and, more particularly, grounding clips for electrical fixtures that may easily be slipped onto and off of the out turned ends of a mounting yoke of an electrical fixture such as a receptacle.

The grounding clip of the present invention is particularly well adapted to be easily slipped onto and off of the out turned ends of the mounting yoke of an electrical receptacle. When the grounding clip is assembled to the mounting yoke, it provides a ground from the receptacle to the junction box, thereby eliminating potentially hazardous conditions that may occur when electrical fixtures are not properly grounded.

Devices which are intended to afford protection against the hazards of improperly grounded electrical fixtures have been heretofore known in the art. However, such known devices have had several inherent disadvantages, such as for example, not being readily adaptable to an electrical receptacle without modification, thereby increasing manufacturing cost appreciably; not affording adequate protection against improper grounding due to insufficient contact between the receptacle and ground; inhibiting removal of the receptacle from the junction box; or being complicated in construction and installation and difficult and expensive to manufacture or the like.

Briefly, the present invention comprises a spring metal clip which is doubled over to form a U-shape which narrows toward the mouth of the "U". Apertures are formed in the sides of the clip to receive a mounting screw. The aperture in the upper side of the clip (when it is assembled to a yoke) is partially defined by an inwardly extending tongue bent slightly toward the interior of the U shape to enter the aperture on the tab when the clip is assembled to it and thereby couple the clip to the tab while permitting its removal. The lateral edges of one side of the clip is serrated and bent toward the other side of the clip. When the mounting screw is tightened, the teeth bite into the tab of the yoke and flatten out under spring action to slightly gouge the surface of the tab of the yoke and scrape away any oxide that may have formed on the surface. This insures a good electrical contact between the yoke and the box to which the receptacle is mounted which will not deteriorate with age or use.

Other features and advantages of the present invention will be apparent from the following description and claims and are illustrated in the accompanying drawings which, by way of illustration, show a preferred embodiment of the present invention.

DESCRIPTION OF THE DRAWINGS

FIG. 1 is a (shown in fragmentary form) front view of an electrical receptacle mounted to an electrical box and including a grounding clip constructed according to the present invention;

FIG. 2 is a close up view of the grounding clip assembled to a mounting yoke of an electrical receptacle;

FIG. 3 is a side view taken along line 3—3 of FIG. 2;

FIG. 4 is a lower side view of the clip of FIG. 2;

FIG. 5 is a cross sectional view of the clip taken along line 5—5 of FIG. 4;

FIG. 6 is a close-up view of the teeth of the clip;

FIG. 7 is an end view of the clip taken along the line 7—7 of FIG. 5 to illustrate the orientation of the teeth.

DETAILED DESCRIPTION

A standard duplex receptacle 12 is shown in FIG. 1 assembled to an electrical mounting box 11 of conventional construction. The mounting or junction box 11 is open-faced, rectangular in shape and has tabs (one of which is seen at 23) extending laterally outward of opposite end with threaded openings 22 therein for receiving screws 16 for mounting the receptacle to the box. Under common practice the box 11 is electrically conductive and is itself electrically grounded.

The receptacle 12 includes a body 13 of insulative material to which is attached a conductive metallic mounting yoke 15. The mounting yoke 15 is made of conducting material and extends across the back of the body 13 of the receptacle 12, along two opposing sides of the body 13 and projects laterally outward at both of its ends to form tabs which align with the tabs of the mounting box 11. The tabs of the mounting yoke 15 are provided with laterally elongated slots 20 (shown in phantom in FIG. 2) in alignment with threaded openings in the tabs on the mounting box 11.

The duplex receptacle 12 has two grounded outlets 19. Each outlet has a pair of parallel spaced slots 17 and a semi-circular opening 14 forming the female grounding contact. The mounting yoke 15 is connected to or forms the contact for the female ground openings 14 for both receptacles, and it provides a means of connecting the receptacle grounds to the building ground via the junction box and clip to be described.

A screw terminal means 24 is usually provided on the mounting yoke 15 for connecting a grounding wire extending from the mounting yoke 15 to the mounting box 11. Such a connection is awkward, time-consuming and expensive, and many times omitted, or overlooked by the installer or inspectors and repair personnel creating a safety hazard.

Typically, the openings 20 at the ends of the mounting yoke 15 are elongated and enlarged to facilitate the alignment of the openings 20 in the mounting yoke 15 with those in the tabs of the mounting box 11. The mounting screws 16 for the receptacle 12 generally have shafts 21 of a smaller diameter than the openings 20 in the mounting yoke 15 through which the screws 16 extend. It is possible to mount an electrical contact between the ungrounded receptacle 12 and the grounded mounting screw 16 and the mounting box 11.

Pursuant to this invention, grounding contact between an electrical receptacle 12 and a mounting box 11 is assured by a grounding clip 30 which by spring action forces conductive metal against the shank of a conductive metal mounting screw 16 and flat surfaces of a mounting yoke 15.

The grounding clip 30 is made of a resilient conductive material, such as a spring metal strip. As can be seen in FIGS. 3 and 5, the grounding clip has a generally U-shaped configuration comprising first and second side members 31 and 32 connected by a curved portion 42. It will be observed from FIG. 5 that the distal ends of sides 31, 32 form a mouth 32A for fitting over the tab of the yoke 15, and the separation of the sides 31, 32 increases from the mouth 32A to the curved portion 42—i.e. the side members are not parallel for reasons that will be explained subsequently.

Referring now to FIG. 4, the side member 32 (sometimes referred to as the "lower" side member of the clips because it is assembled to the bottom of the tab of the yoke) has a rectangular opening 35 for receiving a mounting screw 16. The upper side member 31 has a screw receiving means 45 as best seen in FIGS. 2, 3 and 5. The screw receiving means 45 has a rectangular opening 38 partially defined by an inwardly extending spring tongue 36 which extends away from mouth 32A toward the curved portion 42 of the U-shaped clip 30 downwardly toward the lower member 32. When the clip 30 is assembled to the yoke, the tongue 36 extends into the opening 38 of the yoke and prevents inadvertent removal of the clip. The curvature of the connecting portion 42 of the spring clip and the inclination of the side members (i.e. the increased spacing away from the mouth 32A of the clip) facilitate removal of the clip by pulling the lead portion 40 upwardly to disengage the tongue 36 from the aperture of the tab and then slipping the clip off the tab.

The tongue 36 has a screw-engaging edge 37 which cooperates with a similar screw-engaging fixed edge 39 of the rectangular opening 38 opposite the tongue 36 to hold the screw. The distance between the screw engaging edges 37, 39 is less than the diameter of the shaft 21 of the mounting screw 16. The tongue 36 compensates for different thread sizes. As the mounting screw 16 is inserted and turned into the opening between the screw engaging edges 37, 39 the tongue is drawn up and the edge 37 is forced into the threads of the screw in tight engagement to thereby insure reliable electrical continuity.

The lateral edges of the side member 32 grounding clip 30 are serrated to form a series of teeth 34 having sharp edges which extend towards the other side member 31 and laterally outward, as can best be seen in FIGS. 3, 5 and 7. The side member 31 and the teeth 34 of the lower member 32 are separated from the inboard end of the tongue 36 so as to engage the mounting yoke 15 after the mouth of the clip receives the yoke.

As the mounting yoke is turned and the tongue 36 is drawn upwardly, the screw will shortly be firmly trapped between the screw edges 37, 39. Further tightening of the screw will cause the upper side 31 of the clip to be drawn tightly against the mounting tab 23 on the box 11. This forces the mounting yoke 15 downwardly against the tab of the mounting box 11, trapping the lower side member 32 of the grounding clip 30 between them and causing the teeth 34 to bite into the lower surface of the tab of the yoke. Further turning of the screw will cause the inclined teeth to flatten out in the direction of the arrows, as can be understood from the relationships established in FIG. 7. The teeth 34 due to their outward lateral displacement bite into and scratch the surface of the yoke 15, removing surface material and establish a good metal-to-metal contact. The opposing action of the sets of teeth 34 resists any shift in the position of the grounding clip 30 caused by the flattening of the teeth; therefore, the compression force of the teeth 34 will be directed primarily against the mounting yoke 15, further digging into and scraping the mounting yoke and assuring good electrical contact is made between the grounding clip 30 and the mounting yoke 15. Because the material of the clip 30 is spring steel, the teeth are not permanently flattened as a result of this action, so that the clip may be re-used.

As seen in FIGS. 3 and 5, the distal ends of the upper and lower side members 31 and 32 are angled outward forming guide or centering flanges 40 and 41 which facilitate the initial insertion of the mounting yoke 15 to the clip 30. The clip 30 may then be easily slipped onto the laterally extending ends of the mounting yoke 15 by positioning the mounting yoke 15 between the upper and lower flanges 40 and 41, and as the mouth of the clip 30 is pushed over the yoke 15, the teeth 34 and tongue 36 separate the upper and lower side members 31 and 32.

The alignment of the rectangular openings 35 and 38 in the grounding clip 30 with the elongated slot 20 of the mounting strap shown in phantom in FIG. 2 is facilitated by the downward extension of the tongue 36 of the grounding clip 30 which slides into the slot of the yoke as the grounding clip is forced over the yoke, thereby coupling the clip loosely in place.

To remove the clip, if desired, the flange 40 is raised with the thumb or thumbnail until the tongue 36 clears the tab on the yoke, and the clip is then simply slid off the yoke with the other fingers of the same hand. The inclination of the side members 31, 32 relative to each other and narrowing toward the mouth 32A of the clip facilitates this action.

In operation, the flanges 41 and 42 facilitate the initial insertion and also guide the clip to proper alignment of the mounting yoke 15 into the grounding clip 30 by separating the upper and lower members 31 and 32. Proper lateral positioning of the grounding clip 30 on the mounting yoke is indicated when the spring tongue 36 snaps into the elongated opening 20 of the mounting yoke 15.

The duplex receptacle 12 is then assembled to the mounting box 11 with the elongated opening 20 of the receptacle 12 and the rectangular openings 35 and 38 of the grounding clip 30 in alignment with the threaded opening 22 in the tab 23 of the mounting box 11. A mounting screw 16 is then threaded through the screw-receiving means 45 of the grounding clip and inserted through the opening of the elongated slot 20 of the receptacle 12, through the opening 35 in the lower member 32 and into the threaded opening 22 of the tab 23 of the mounting box 11. The spring tongue 36 of the screw-receiving means 45 is disposed for exerting contact pressure against the threads of the mounting screw 16 to establish a positive electrical contact between the grounding clip 30 and the mounting screw 16. Due to the deflectable nature of the inwardly extending spring tongue 36, the screw receiving means 45 is also self-adjusting for variation between the threads of different mounting screws.

As the mounting screw 16 is turned into the aperture 22 of the junction box, the mounting box 15 is forced against the tab of the box with the lower side 32 of the clip trapped between them. As the screw is further turned, the teeth 34 of the grounding clip are flattened and exert a concentrated contact pressure on the surface of the mounting yoke 15 due to the spring temper of the material of the U-shaped clip 30, and thereby gouge that surface and scrape off any oxide or non-conductive coatings on the surface of the mounting yoke 15 and assure a good electrical contact between the grounding clip 30 and the mounting yoke 15.

From the foregoing, it will be seen that the present invention affords a novel grounding clip for electrical receptacles and the like assuring electrical contact with a screw 16 used to mount electrical fixtures, the mounting yoke 15 and the mounting box 11. A path of high conductivity is thereby established from the mounting yoke 15 to the compressed teeth 34, the screw receiving means 45, through the body of the screw 16 to the grounded mounting box 11. The use of the grounding clip in no way interferes with the use of the grounding terminal of the receptacle for connecting a grounding wire to the grounding box. The grounding clip acts at a backup grounding path when such a grounding connection is made.

In addition, it will be seen that the present invention affords a novel grounding clip for electrical fixtures which is practical and efficient in operation and which may readily and economically be produced commercially. The present invention requires few operations to press and bend the spring steel to its form and does not require any rolling operations. Further, the present invention may easily be applied to or removed from existing fixtures with little or no modification. The teeth substantially resume their original position after the lower member 32 is compressed between the mounting yoke 15 and the tabe 32 of the mount box allowing the clip to be reused.

Thus, while I have illustrated and described the preferred embodiment of my invention, it is understood that this is capable of variation and modification, and I, therefore, do not wish to be limited to the precise details set forth, but desire to avail myself of such changes and alterations as fall within the purview of the following claims.

I claim:

1. A grounding clip for use with an electrical fixture having a mounting yoke by which the fixture is secured to a grounded mounting box with mounting screws extending through a slot in the mounting yoke and into a threaded opening in a grounded mounting box, said grounding clip comprising: a U-shaped element of spring steel having first and second side members, spaced apart to form a mouth for receiving and exerting pressure against said mounting yoke and said second member adapted to be interposed between said yoke and said box and having an aperture for the free passage of said mounting screw therethrough, and said first member having a screw-receiving means including an opening and a spring tongue, said opening located in alignment above said aperture in second member; said spring tongue extending inwardly into said opening toward said second side member of said clip, said tongue being formed integrally with said first side member and in diverging relation therewith and having a screw engaging edge cooperating with an opposing edge of said opening to receive and establish electrical communication with said screw, said spring tongue adapted for aligning and maintaining said clip about the mounting yoke as said clip is positioned on said mounting yoke and said spring tongue is received in said slot; said second member defining teeth for biting into said yoke and scraping any oxide therefrom as said mounting screw is turned into said threaded opening of said box.

2. The apparatus of claim 1 wherein said first side member and screw receiving means are positionable on the side of the mounting yoke away from said mounting box; and wherein said second side member is interposable between said box and said yoke and said teeth are flattened outwardly as said yoke is drawn toward said box when said screw is tightened; said mounting screw pressing down on said first side member as said mounting screw reaches the end of its travel and threads of said mounting screw holding said spring tongue in place, narrowing the distance between the screw engaging edge of said spring tongue and said opposing edge of said opening of screw-receiving means, and tightening said screw-receiving edge against said mounting screw; and said screw-receiving means and mounting screw maintaining electrical continuity therebetween.

3. The apparatus of claim 1 wherein said teeth concentrate the contact pressure exerted against the mounting yoke by said U-shaped spring clip; and said teeth yieldably deflect when pressed against the surface of said mounting yoke to maintain electrical continuity therewith.

4. The apparatus of claim 1 wherein said teeth are formed on said second side member, opposite said first side member; said second member being positioned between said tab of said box and said mounting yoke; said teeth concentrating the force of compression against said surface of said mounting yoke as said mounting yoke is tightened against said tab of said box and deflecting along and scraping the surface of said mounting yoke to maintain electrical continuity therewith.

5. The apparatus of claim 4 wherein said teeth are located on opposite edges of said second member and extend laterally outwardly of said clip in oblique angles to define acute angles with the surface of said yoke which they engage; said teeth being angled in opposite directions to resist movement of said grounding clip as said mounting yoke is tightened against said mounting box and said teeth are flattened.

6. The apparatus of claim 1 wherein said grounding clip is detachably mountable on said mounting yoke with said first and second side members on opposite sides of said mounting yoke surfaces and one of said slots in said mounting yoke aligned with said aperture and said screw receiving means of said grounding clip; said clip providing a path of low electrical resistance between said mounting yoke, mounting screw and mounting box.

7. The apparatus of claim 6 wherein said spring tongue extends toward a proximal end of said first side member to facilitate the assembly of said clip on said mounting yoke and to obstruct its removal therefrom.

8. The apparatus of claim 7 wherein the distance between said side members increases when proceeding from the distal ends thereof to the connecting portion of said U-shaped clip; said increase in said distance providing a space between said side members and said mounting yoke to lift said tongue out of said slot in mounting yoke to facilitate removal of said grounding clip from said yoke.

9. The apparatus of claim 6 wherein said first member and screw-receiving means are positioned on the side of the mounting yoke opposite said mounting box; said mounting screw pressing down on said first member as said mounting screw reaches the end of its travel and threads of said mounting screw drawing said spring tongue outwardly of said clip, thereby narrowing the distance between the screw-engaging edges of said spring tongue and said straight edge of opening of screw-receiving means, and tightening said screw-receiving edges against screw.

10. The apparatus of claim 9 wherein said teeth concentrate the force of compression against said surface of said mounting yoke as said mounting yoke is tightened against said tab of said mounting box; and said teeth bear against and scrape the surface of said mounting yoke maintaining electrical continuity therebetween while deflecting outwardly to gouge said surface.

11. The apparatus of claim 9 wherein said teeth are integral with and formed out of the material of one of said members and extend towards said opposite member at an acute included angle.

12. The apparatus of claim 11 wherein the distal ends of said members of said grounding clip diverge to facilitate the positioning of said grounding clip on said mounting yoke.

13. The apparatus of claim 12 wherein said teeth are located on opposite edges of said second member and angled in opposite directions relative to each other and said teeth and second member are positioned between the tab of said mounting box and said mounting yoke; said teeth being inclined in opposite directions equally to resist movement of said grounding clip as mounting yoke is tightened against mounting box and said teeth are flattened to direct the forces of compression into said mounting yoke and scrape the surface of the mounting yoke.

14. An electrical fixture comprising: a mounting yoke by which the fixture is secured to a grounded electrical box with mounting screws extending through a slot in the mounting yoke and threaded into an opening in said box; and a grounding clip comprising: a doubled-over spring having first and second members joined by a connecting portion and inclined relative to each other to define a narrowing distance between them proceeding away from said connecting portion; said second member having an aperture for the free passage of said mounting screw therethrough, and said first member having a screw-receiving means located in alignment above said aperture in said second member, said screw-receiving means engaging said mounting screw and including an opening having a spring tongue extending inwardly thereof and toward second member, said spring tongue formed integrally with said first member and having a screw-engaging edge cooperating with a fixed edge of said opening opposite said spring tongue to engage the threads of a mounting screw; said screw engaging edge of said spring tongue pressing against said mounting screw, forcing said mounting screw into said straight screw engaging edge on opposite side of said opening of said screw-receiving means, and maintaining electrical continuity therebetween as said mounting screw is axially engaged in said screw-receiving means; and said grounding clip detachably mountable on said mounting yoke with said first and second members on opposite sides of said mounting yoke surfaces and said tongue extending into an associated slot in mounting yoke.

15. The apparatus of claim 14 further comprising a grounding terminal screw threadably engaged in said mounting yoke; said grounding terminal screw for connecting a ground wire from the mounting box to the mounting yoke to provide an alternative grounding path when used with a ground wire and said grounding clip.

* * * * *